US005186574A

United States Patent [19]

Tavares

[11] Patent Number: 5,186,574

[45] Date of Patent: Feb. 16, 1993

[54] INTERLOCKING GROUND SLAB ELEMENT AND METHOD

[76] Inventor: Wayne R. Tavares, P.O. Box 543, Mashpee, Mass. 02649

[21] Appl. No.: 833,364

[22] Filed: Feb. 10, 1992

[51] Int. Cl.[5] ..... E01C 5/02; E01C 5/04; E01C 5/06

[52] U.S. Cl. ..... 404/73; 404/41; 404/42

[58] Field of Search ..... 404/73, 41, 42; 52/102, 52/589, 590, 608

[56] References Cited

U.S. PATENT DOCUMENTS

| | | | |
|---|---|---|---|
| 244,594 | 7/1881 | Guyer . | |
| 722,580 | 3/1903 | Hill | 52/102 X |
| 1,314,586 | 12/1919 | France | 404/41 |
| 2,600,090 | 12/1957 | France | 404/42 |
| 2,888,779 | 6/1959 | Hostetter | 52/102 X |
| 4,544,305 | 10/1985 | Hair | 404/41 |

FOREIGN PATENT DOCUMENTS 1314586 4/1982 France .

*Primary Examiner*—Stephen J. Novosad
*Attorney, Agent, or Firm*—Richard P. Crowley

[57] ABSTRACT

A slab element for covering a ground surface and the like, the linear, curvilinear, and circular-design surfaces produced by the slab elements, and a method of forming the design surfaces. The slab element comprises a rectangular slab element having a convex and a concave end adapted to interlock and be rotatable, with grout material therebetween, and the peripheral sides of the slab element entirely curvilinear.

18 Claims, 8 Drawing Sheets

FULL SLAB ELEMENT

QUARTER

HALF

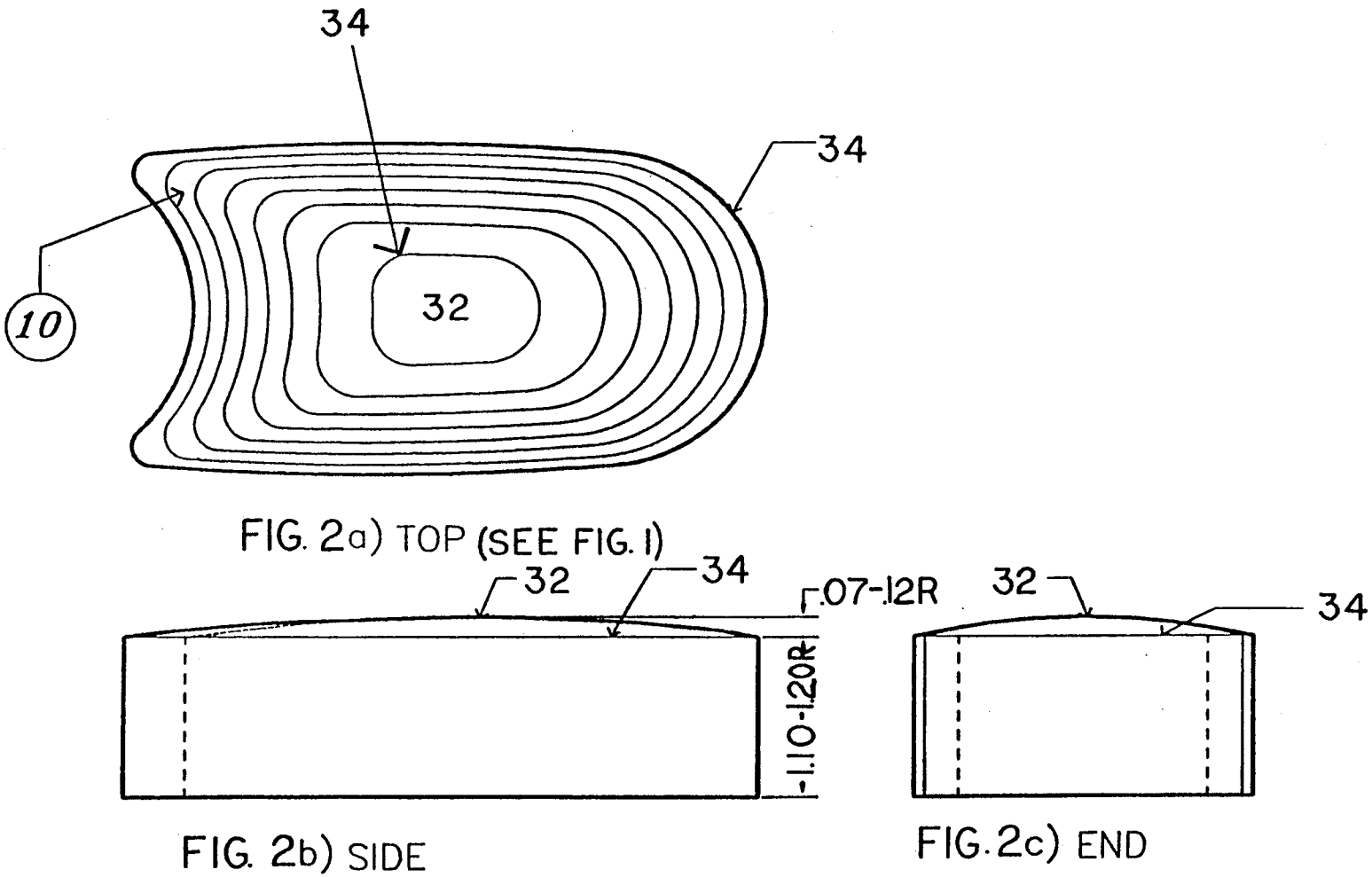
FIG. 2a) TOP (SEE FIG. 1)
FIG. 2b) SIDE
FIG. 2c) END

STANDARD CIRCLE PATTERN

ALTERNATING CIRCLE PATTERN

SPIRAL CONFIGURATION

INTERLOCKING GROUND SLAB ELEMENT AND METHOD

BACKGROUND OF THE INVENTION

Bricks, paving tones, slabs and other slab-like elements are typically employed, to provide a ground cover for walks, patios and other purposes. Generally, such slab or slab-type elements are placed in position on prepared ground, and then secured together using intervening grouting material, both as a spacer and as an adhesive material between the slab elements.

Various interlocking slab elements, for covering any flat surface, such as the ground, and employing a plurality of the slab elements, to provide various surface designs and configurations, have been suggested. Generally, these slab elements are combined together in an interlocking manner, with a grout material as a bonding, filling and spacing agent therebetween. For example, one type of an interlocking slab element is described in U.S. Pat. No. 4,544,305, issued Oct. 1, 1985, wherein the interlocking slab element has a main hexagonal section and a rectangular tail section integral therewith. Other slab elements proposed in the past include slab elements of stone pavements, having convex sections at one end and concave sections at the other end, such as, for example, as illustrated in U.S. Pat. No. 244,595, issued Jul. 19, 1881, and more particularly for example, French Patent 1,314,586.

Slab elements or pavement units of different shapes traditionally have been used throughout history for all types of traffic-bearing surfaces, such as paths, roads, patios, driveways, borders and ramps. Usually and recently, these paving elements or pavers have been made of concrete; that is, a hard, durable and molded material. However, other materials may be used, but not be limited to, including actual stone, wood, clay, plastic or other organic and man-made materials suitable for slab elements. Such slab elements permit the formation of traditional straight or linear patterns.

It is desirable to provide for a new and unique, interlocking, surface slab element or paver for covering the ground and the like, which permits curvilinear and circular patterns with minimum joints therein, and wherein the overall designs utilize a plurality of the slab-like elements, varying only in length.

SUMMARY OF THE INVENTION

The invention relates to an interlocking slab element and to surface designs, particularly curvilinear surface designs, using the slab elements, and the method of so preparing such designs.

An interlocking surface of ground slab element (paver) has been discovered which is particularly adapted to form a flat or ground surface of a selected design, and particularly a curvilinear or circular design, employing a plurality of the ground slab elements, typically with grout material as a bonding filler and a spacing agent in between the elements, in an interlocking and rotating relationship.

The ground slab elements of the invention comprise a generally rectangular, elongated, ground slab element composed of a hard material, and having at top surface and a one and another end, and generally a thickness of less than the width or the length of the ground slab element. The ground slab element has, at the one end of the slab element, a convex, arcuate surface, having a radius R and extending generally from one to the other side of the slab element. In addition, the ground slab element includes, at the other end of the slab element, a concave, arcuate surface, and the ground slab element has a radius at he concave end greater than the radius R of the convex end of the ground slab element, so as to provide for the convex end of the slab element to fit, in a mating, interlocking relationship, within the concave end of the slab element, so as to permit both interlocking and at least partial rotatability of the ground slab elements, while allowing space for grout material. Such an arrangement provides for the formation of arcuate-design surfaces, by the use of a plurality of such slab elements in an interlocked and, optionally, a rotatable relationship. Also, the invention is characterized, at the outer periphery of the ground slab element, by being curvilinear throughout the periphery of the slab element.

The ground slab element typically has a concave radius which ranges from about 1.05 to 1.10 R, and wherein the length of the slab element ranges from about 1.5 to 4.0 R, and the width of the ground slab element ranges from about 2.5 to 2.15 R. Such ground slab element may have the top surface in a generally convexly rounded manner from the top center of the slab element outwardly toward the curvilinear perimeter of the ground slab element. The ground slab element, where it has a length of about 4 R, has a maximum angle of rotation of the convex/concave ends, in an interlocked rotation, of up to about 12 degrees, 45 minutes. With a half-length, ground slab element, the maximum angle of rotation is about 23 degrees, 30 minutes, and, with a quarter ground slab element, the maximum angle of rotation extends up to 45 degrees, 0 minutes. Thus, the ground slab elements may be made available in full- , half- and quarter-length sizes, and which, alone or in combination, provide for unique curvilinear and circular design patterns for use of the interlocked, rotatable elements together.

The ground slab element is particularly characterized by curvilinear sides, which range from about 15 to 20 R from the points of compound curvature at each end of a full ground slab element, having a length of 4.0 R. As more particularly described herein, the radius of the concave end has a larger radius than the convex end of the ground slab element, so as to accomodate the convex end in an interlocking and rotating manner, while allowing a space for grout material, whereby, upon installation, the concave and convex ends may be fitted together matingly in a plurality of like slab elements, to rotate and interlock through any circle or arc within reason. The ground elements include full ground elements, as well as shorter-in-length; that is, half- and quarter-size, ground slab elements, to provide for a smaller radii and as filler pieces for total circles comprised of original-length, ground slab elements that do not fill mathematically the circle design. Thus, a plurality of ground slab elements of the invention may be employed in different lengths, to accomodate smaller radii in preparing ground surface designs.

The outer periphery of the ground slab element is curvilinear throughout, with no straight lines, and with a minimum of four, different radii composed of two pairs for six total radii. The combination of a plurality of the ground slab elements may be used to form grout lines that are equal at the end joints and unequal along the longitudinal joint lines, but not so much so as to be dysfunctional or unaesthetic. The necessity of unequal, longitudinal joint lines is a function of the rotation about a circle and the pavers of equal length in adjacent rows, to command more ground slab elements per row as the radii of the curvilinear design increases, thereby making the mating of the two ground slab elements in adjacent rows unique and varied in width. The minimum ground joint is the same width as set forth, and a maximum joint line being approximately three times the preceding dimension.

In the formation of curvilinear patterns employing the ground slab elements, such patterns often have a circular axis that dictates the shape and spacing of the individual, ground slab elements. Circles of smaller radii of ground slab elements can be assembled and formed with three different motifs of these elements; that is, full-, half- and quarter-size. Patterns with sinusoidal curves can be produced with any or all of the three full-, half- or quarter-length ground slab elements. Random curvilinear models with smaller radii can be constructed using these elements, while spiral and non-mathematical curves also can be constructed.

It has been found that the unique shape of the ground slab elements of the invention, coupled most importantly with the patterns in which they are utilized, adds unique properties and strength in lateral resistance to the movement of the ground slab elements, due to the interlocking capabilities and mathematical integrity of the final model. Although longitudinal joints appear in the many patterns possible, by the use of the ground slab elements, the curvilinear pattern inhibits lateral motion through the locking ability of circular arcs, and especially complete circles. It is important to minimize the unequal joint spacing in the use of the ground slab elements that must accompany the varying patterns, without losing lateral or load-bearing integrity.

The method of interlocking of the slab elements is threefold. Firstly, along the vertical (longitudinal) axis, each slab element is separated by the center length of the paver. This represents the distance from the center of the concave end to the center of the convex end. The center-to-center distance is also equal to the distance between the convex and concave ends along the longitudinal center line of the elements, plus the difference in their respective radii. No slab elements can or should be installed at any other distance. This maintains the convex end to be seated into the concave recess.

Secondly, the units are interlocked laterally by this same coupling of the convex end into the concave end of the subsequent element. Although the circular shape of the overall pattern allows for pivoting on the centers of their respective ends, the lateral, curved side of the concave end supports and maintains the location of the convex end of the prior element. Therefore, end-to-end (longitudinal) distance is maintained and then side-to-side (lateral) support is provided. In curvilinear patterns only, the lateral integrity of each row is supported by the mathematical integrity of the adjacent row. Also, the curvilinear, outside edge creates a single point of support from the adjacent row. This is an area that has the minimum, lateral, joint distance equal to the difference between the two end radii. This is the minimum, lateral, joint space possible, to allow for rotation of the individual elements, without their wearing against one another, which causes spalling in concrete material, and should be avoided as a practice. Maximum-rotation angles for full-length slab elements approach 12 degrees, 45 minutes deflection (center line to center line). For half-length slab elements, this deflection angle approaches 23 degrees, 30 minutes, and, for quarter-length slab elements, this deflection is in the order of 45 degrees, 0 minutes. Minimum joint spacing is reduced to one-half minimum only in a maximum deflection, quarter-length slab.

It is beneficial to have dummy joint spacers as an integral part of a new, molded slab element, to act as true spacing joints and to insure a minimum space, either laterally or longitudinally, and should be equal to the difference between the concave and convex radii, and as an angular markation on the convex end of the slab elements, so that certain radii could be approximated, by aligning the dummy joint spacer on the convex end with subtle indentations on the concave end (top side). These marks would be equal to 3 degrees, 6 degrees, 9 degrees, 12 degrees, etc. of angular deflection.

The invention will be described for the purposes of illustration only, in connection with certain embodiments; however, it is recognized that various changes, modifications, additions and improvements may be made by those persons skilled in the art, all falling within the spirit and scope of the invention.

BRIEF DESCRIPTION OF THE DRAWINGS

FIGS. 2*a*–2*c* represent top, side and end views of a convex-top full slab element;

DESCRIPTION OF THE EMBODIMENTS

Figure 1A:
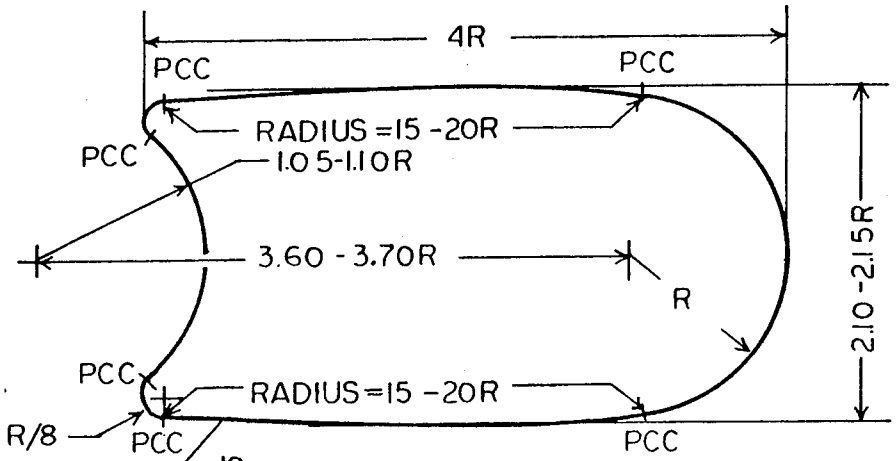
FIGS. 1*a*–1*c* represent the full-, half- and quarter-size representative dimensions, in a top plan view, of the slab elements of the invention.
Figure 1C:
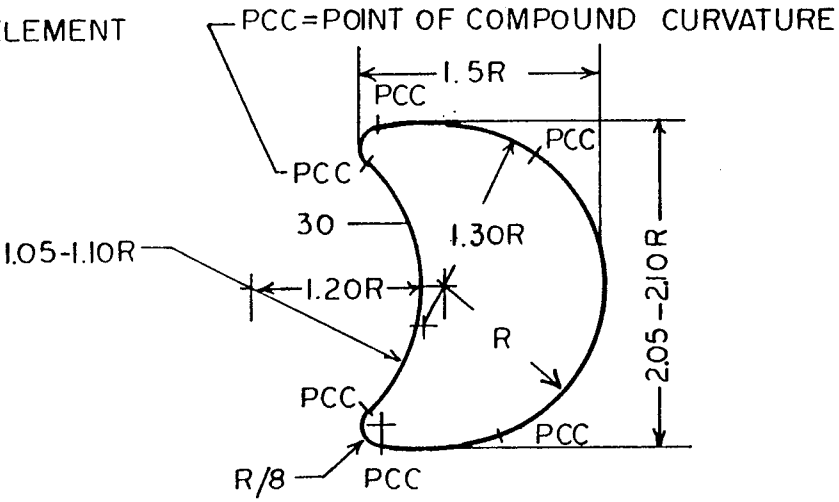
Figure 1B:
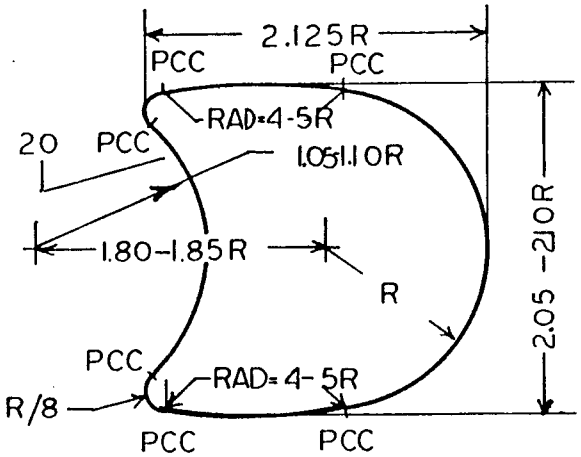

FIGS. 1*a*–1*c* are top plan views showing representative dimensions of the slab elements of the invention, with FIG. 1 a) representing a full paver 10, typically 8 inches long; that is 4 R being 8 inches, and FIG. 1 b) representing a half paver 20, and FIG. 1 c) representing a quarter paver 30, which pavers may be used in an interlocking, rotatable combination, for the purposes of the invention, in forming various straight, curvilinear and circle-type designs. It should be noted that the outer curvature of the slab elements is curvilinear throughout, with no straight lines, having end points of compound curvature, and with a minimum of four, distinct radii symmetrical around a longitudinal axis, plus the convex and concave radii R and R (1.05 and 1.-10) encompassing six defined radii in all. All peripheral curves of the slab elements, except the smallest, have function regarding spacing and interlocking.

FIGS 2*a*–2*c* are top, side and end view illustrations of one preferred slab element, 10 representing a full slab element of FIG. 1 a), employing the top plan view FIG.

2 a), side plan view FIG. 2 b) and end plan view FIG. 2 c). The top surface of the slab element, as illustrated, is convexly rounded from the top center of the slab element 32 outwardly to the perimeter 34 of the full shape at an equidistant elevation below the high point 32. Similarly, quarter and half slab elements, as illustrated in FIGS. 1 b) and c), may be formed similarly.

Figures 3A, 3B:
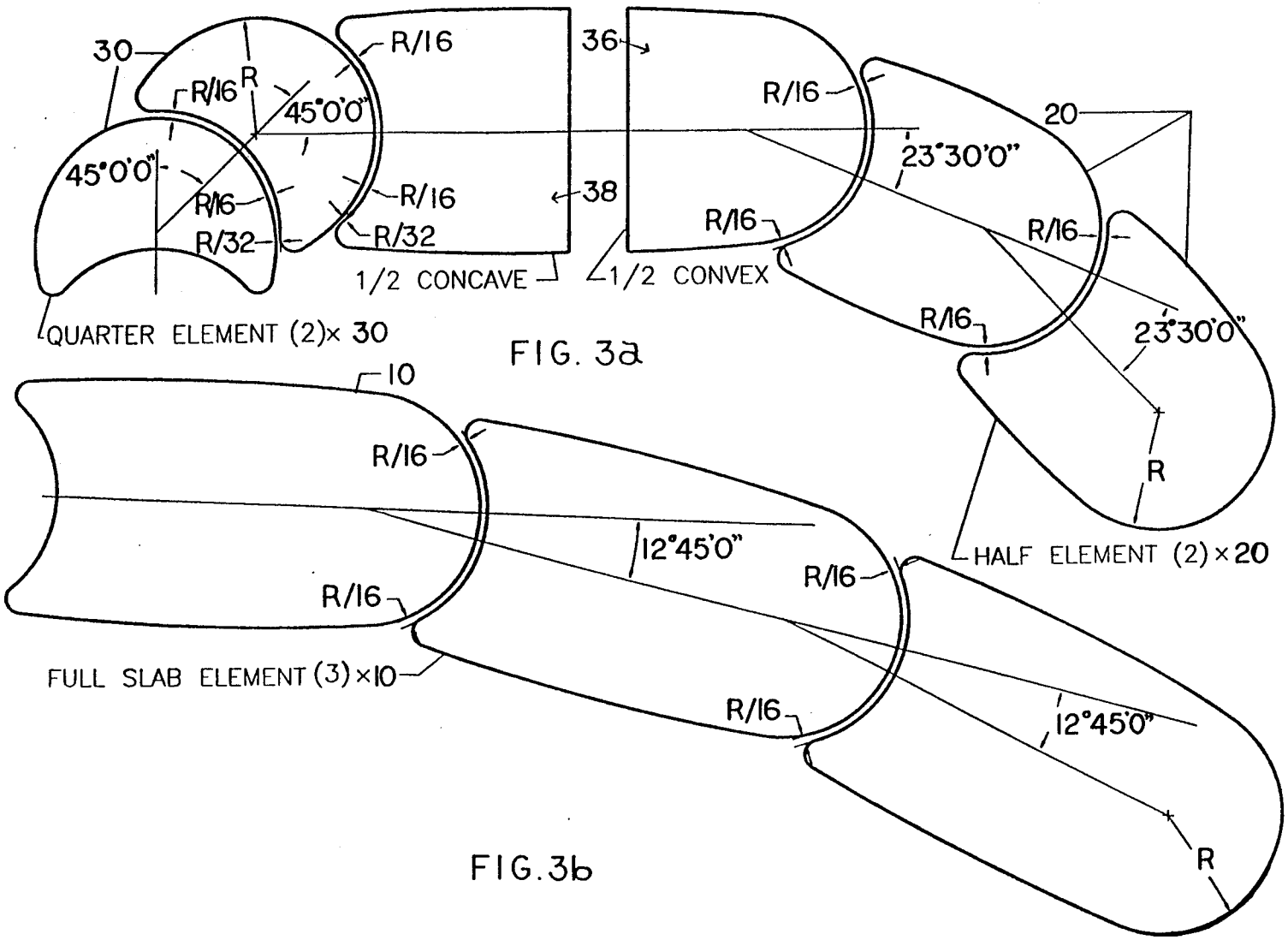
FIGS. 3*a*–3*b* illustrate plan views of five variations of the slab elements of the invention, also illustrating maximum angular deflections and joint spacing.

FIGS 3*a*–3*b* are representative illustrations of a variety of the slab elements shown in an interlocked and a rotatable manner, and represents actually five forms of the interlocking slab element of the invention, including the full, half and quarter sizes illustrated in FIGS. 1*a*–1*c*, together with a convex, half-border element and a concave, half-border element 36 and 38. For the purposes of illustration, the maximum angle deflection on rotating, without spalling of the adjacent element, is illustrated in the drawings. The interlocking slab elements 10, 20 and 30, as illustrated, provide for a wide range of interlocking and rotating movement, when employed in various designs.

Figure 4:
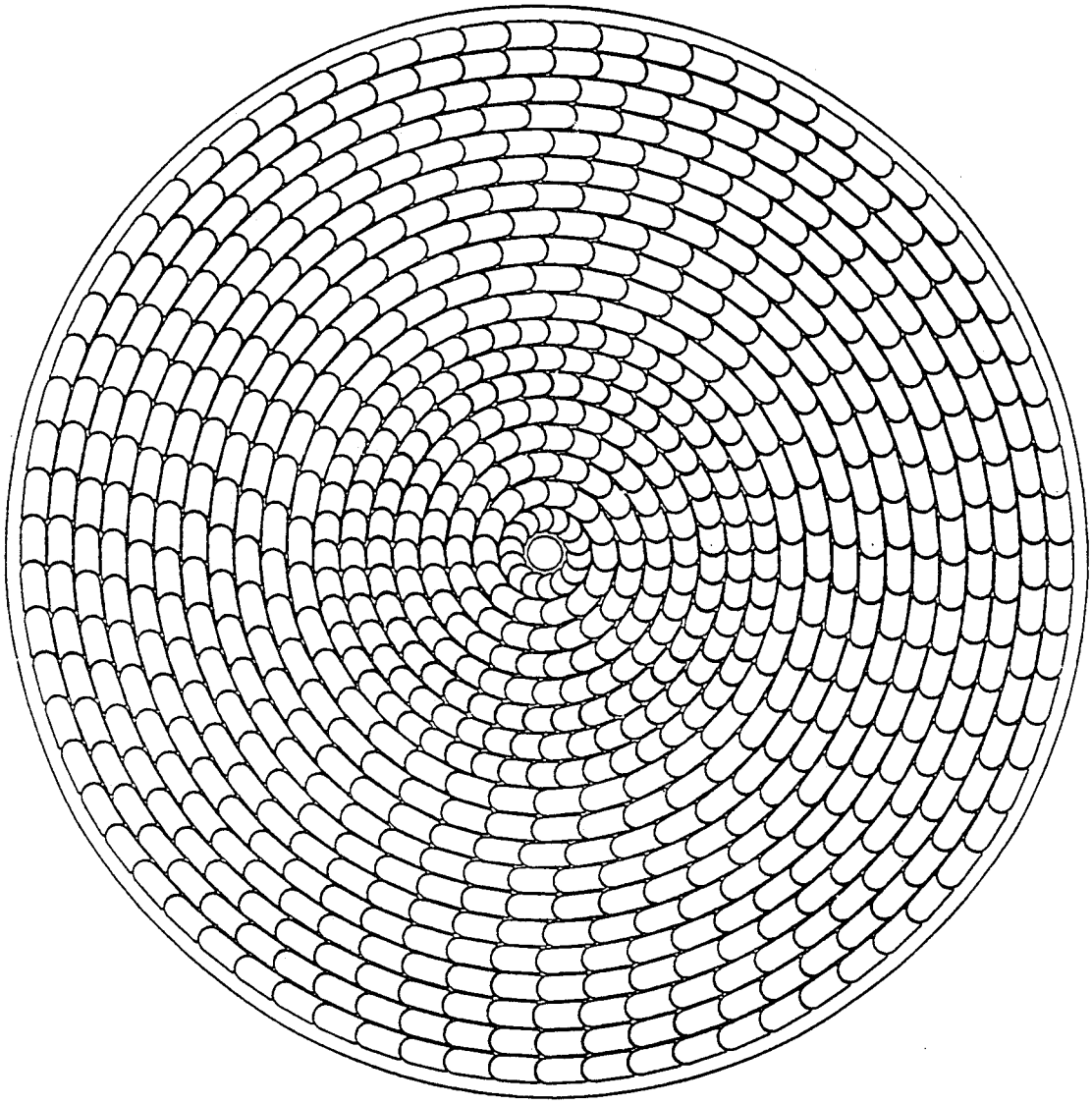
FIG. 4 is a top plan view of a standard circle pattern employing the full, half and quarter slab elements of FIG. 1.

FIG. 4 is a top plan view of a standard circle pattern formed from the slab elements of the invention, depicting all three elements, full 10, half 20 and quarter 30, shown in an interlocking manner, to form a standard circle pattern.

Figure 5:
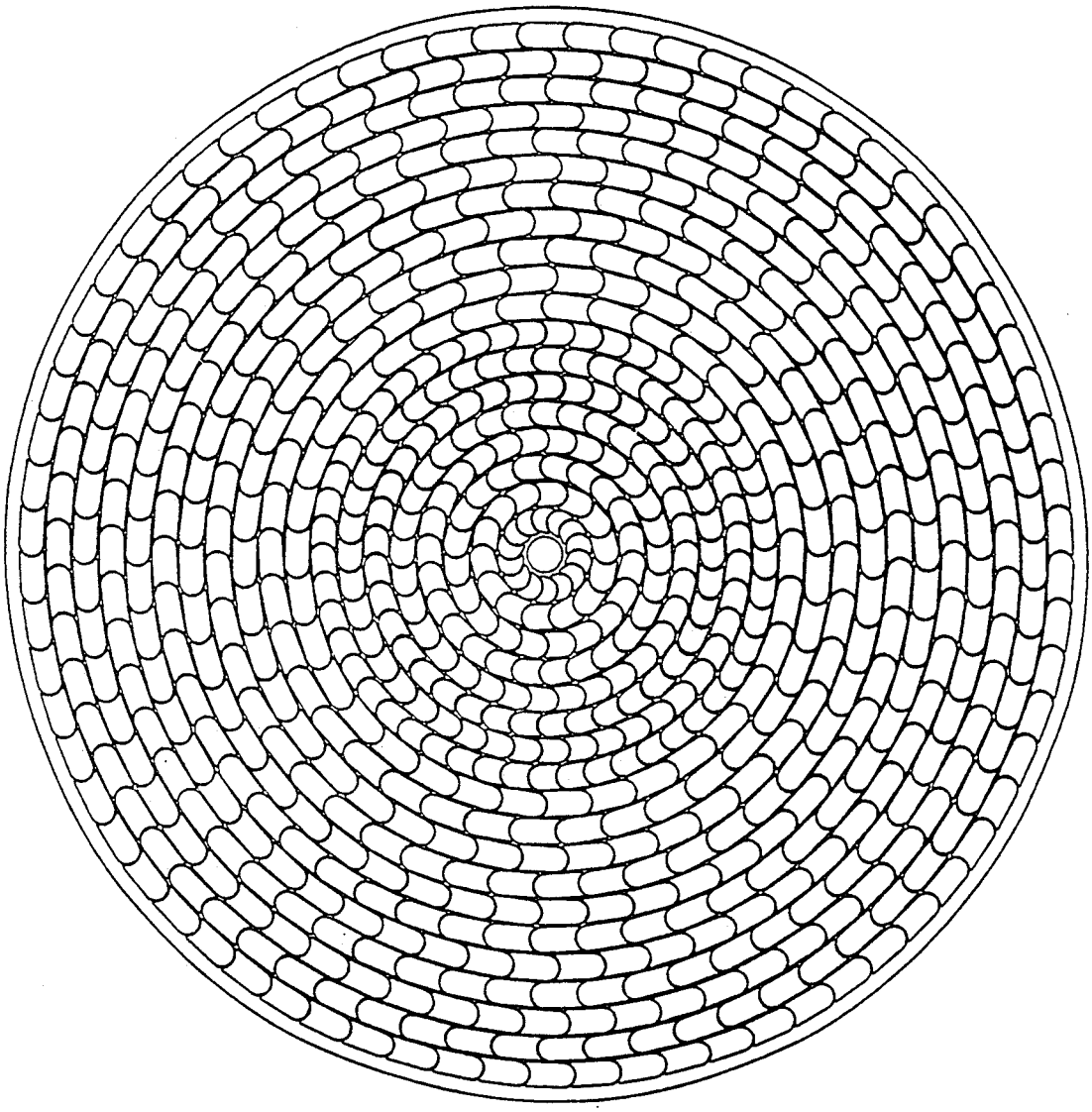
FIG. 5 is a top plan view of an alternating circle pattern employing all the slab elements of FIG. 1.

FIG. 5 is a representation of an alternating circle pattern formed by the use of all three full-, half- and quarter-slab elements of the invention, with each circle row alternating in the direction of the elements, to form a particularly alternating, circle design pattern, such as a patio.

Figure 6:
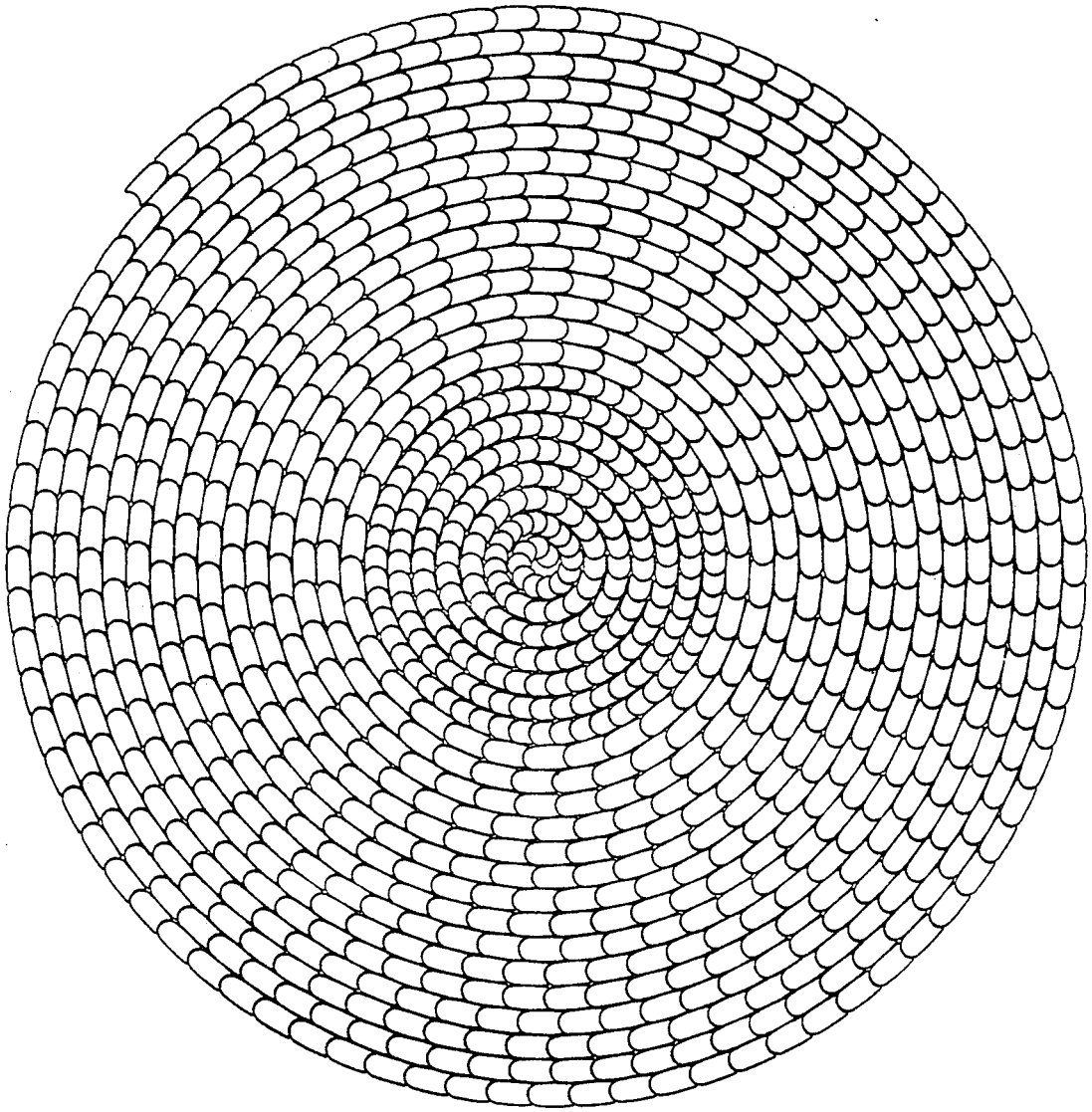
FIG. 6 is a top plan view showing a spiral configuration, showing the use of all the slab elements of FIG. 1.

FIG. 6 is a top plan view of a spiral-configuration pattern formed, employing all three slab elements of the invention, the spiral configuration shown, for example, as a patio depicting a single circle of constantly diminished radii to a common center. As illustrated, as the radii becomes smaller, the full-length slab element 10 gives way to the smaller half-slab element 20, which gives way to the quarter-slab element 30, as the row of slab elements approaches the center of the spiral configuration.

Figure 7:
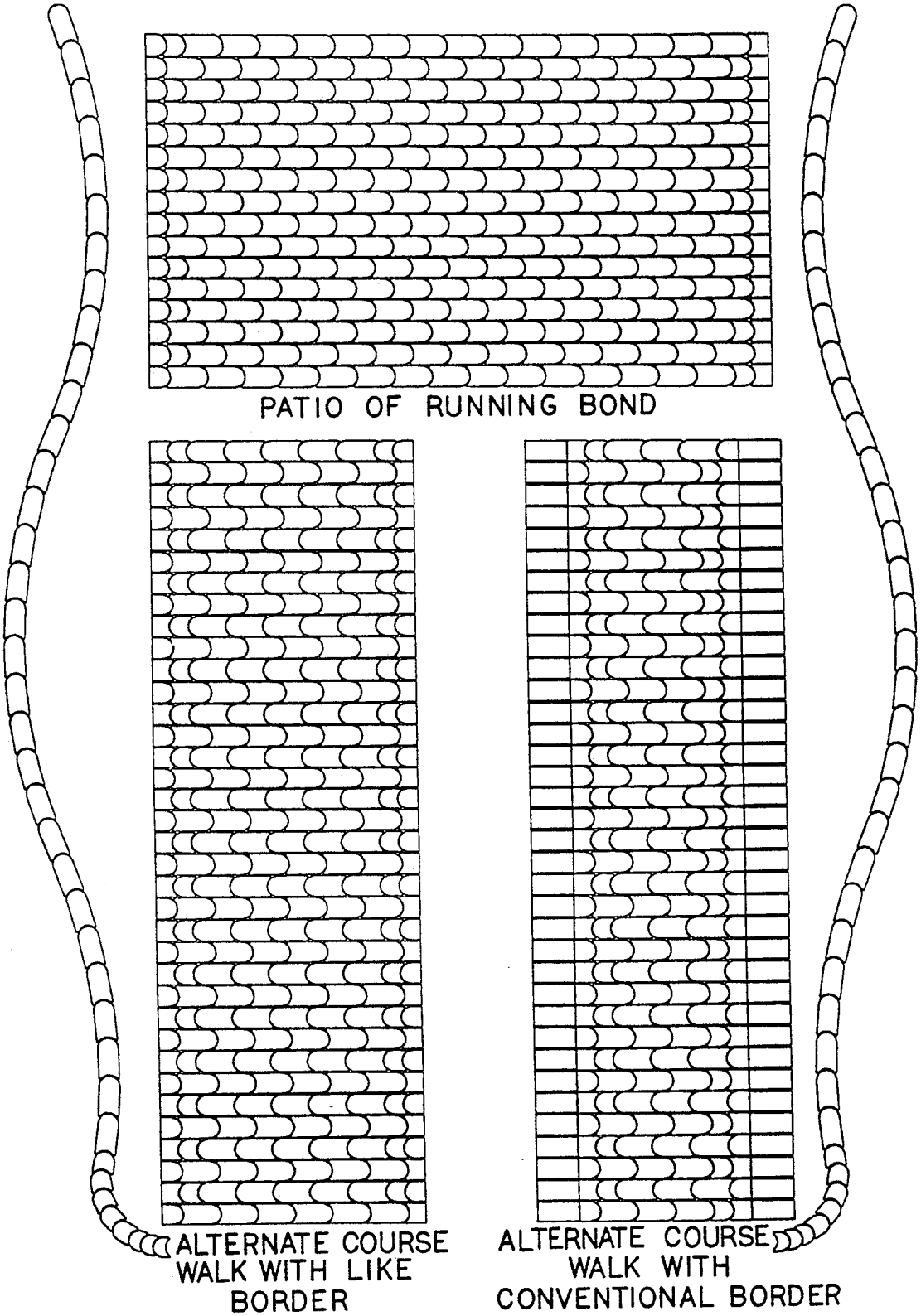
FIG. 7 is a top plan view showing the slab elements of FIG. 1 employing various configurations of forming a patio, a border and walk design patterns in a straight, noncurvilinear fashion.

FIG. 7 is a top plan view of various noncurvilinear or straight-pattern designs formed by the slab elements of the invention, showing a patio with a running bond FIG. 7 a), with the slab elements FIG 7 b) showing an alternating course walk with a like border, and FIG. 7 c) an alternating course walk with a conventional border, and FIG. 7 d) and e) showing the use of the slab elements as a border.

Figure 8:
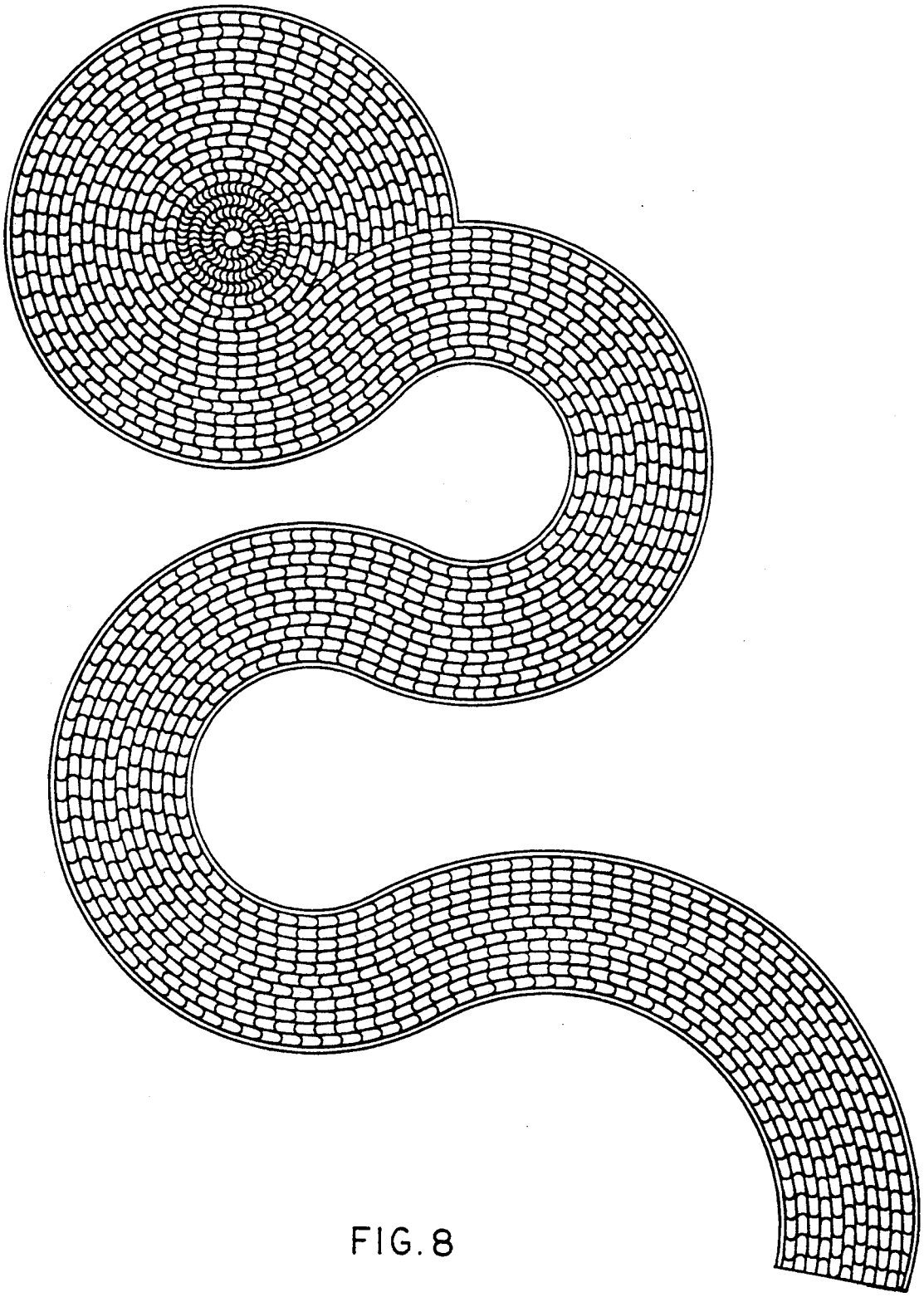
FIG. 8 is a top plan view of a random, multiradii, pathway construction of all slab elements of FIG. 1.

FIG. 8 is a top plan view of a multiradii design with a circular end employing all the slab elements of FIGS. 1*a*–1*c*.

Thus, as described and illustrated, the slab elements of the invention provide for the interlocking and rotating movement of slab elements, to form a variety of straight, curvilinear and circular design patterns.

What is claimed is:

1. An interlockable, ground slab element adapted to form a surface of a selected design, by employing a plurality of the ground slab elements, with grout material as a bonding filler and spacing agent, in an interlocking and rotating relationship, which ground slab element comprises:

a) a generally rectangular, elongated, ground slab element composed of a hard material, and having a top surface and a one and other end, and a thickness less than the width or the length of the ground slab element;

b) the one end of the slab element forming a convex, arcuate surface, and having a radius R and extending generally from one to the other sides of the slab element;

c) the other end of the slab element forming a concave, arcuate surface;

d) the radius of the concave end having a greater radius than the radius R of the convex end, so as to provide for the convex end of the slab element to fit within the concave end of the slab element in an interlocking and partially rotatable relationship, while allowing space for grout material, and to permit the formation of arcuate design surfaces by the use of a plurality of the slab elements; and e) the outer periphery of the slab element characterized as curvilinear throughout the periphery.

2. The slab element of claim 1 wherein the concave radius ranges from about 1.05 to 1.10 R.

3. The slab element of claim 1 wherein the length of the slab element ranges from about 1.5 to 4.0 R.

4. The slab element of claim 1 wherein the width ranges from about 2.05 to 2.15 R.

5. The slab element of claim 1 wherein the top surface of the slab element is generally convexly rounded from the top center of the slab element to the perimeter of the slab element.

6. The slab element of claim 1 having a length of about 4 R and a maximum angle of rotation, when interlocked with an adjacent slab element of the same length, of about up to 12 degrees, 45 minutes.

7. The slab element of claim 1 having a length of about 2.125 R and a maximum angle of rotation, when interlocked with an adjacent slab element, of the same length of about up to 23 degrees, 30 minutes.

8. The slab element of claim 1 having a length of about 1.5 R and a maximum angle of rotation, when interlocked with an adjacent slab element, of the same length of about up to 45 degrees, 0 minutes.

9. The slab element of claim 1 wherein the curvilinear sides range from about 15 to 20 R from the points of compound curvature (PCC) at each end of the slab element.

10. A design surface formed by a plurality of interlocked and rotated slab elements of claim 1, with grout material therebetween.

11. The surface of claim 10 which includes a plurality of combined slab elements, having lengths of 4.0 R, 2.125 R and 1.5 r.

12. The surface of claim 10 which comprises a circular-design surface.

13. The surface of claim 10 wherein the grout lines formed by the grout material are generally equal at each end of the slab elements, and generally slightly unequal along the side grout lines.

14. A method of preparing a surface composed of slab elements, which method comprises:

a) providing a plurality of slab elements of claim 1;

b) matingly interlocking the convex end of the slab elements within the concave end of an adjacent slab element, employing a grout material; and c) forming a flat surface of selected design composed of the interlocked slab elements.

15. The method of claim 14 which includes rotating one or more of the interlocked slab elements, to form a curvilinear-design surface.

16. The method of claim 14 which includes employing a plurality of slab elements having lengths of 4.0 R, 2.125 R and 1.5 R.

17. The method of claim 16 which includes forming a generally circular-design surface.

18. The design surface produced by the method of claim 14.

* * * * *